United States Patent [19]

Ingerson

[11] Patent Number: 4,855,751

[45] Date of Patent: Aug. 8, 1989

[54] HIGH-EFFICIENCY MULTIBEAM ANTENNA

[75] Inventor: Paul G. Ingerson, Torrance, Calif.

[73] Assignee: TRW Inc., Redondo Beach, Calif.

[21] Appl. No.: 210,140

[22] Filed: Jun. 14, 1988

Related U.S. Application Data

[63] Continuation of Ser. No. 47,568, Apr. 22, 1987, which is a continuation of Ser. No. 491,004, May 3, 1983.

[51] Int. Cl.[4] ..... H01Q 3/24

[52] U.S. Cl. ..... 343/779; 343/754

[58] Field of Search ..... 343/779, 781 P, 781 CA, 343/781 R, 754

[56] References Cited

U.S. PATENT DOCUMENTS

| | | | |
|---|---|---|---|
| 3,631,503 | 12/1971 | Tang et al. | 343/754 |
| 3,936,835 | 2/1976 | Phelan | 343/753 |
| 4,090,203 | 5/1978 | Duncan | 343/753 |
| 4,145,695 | 3/1979 | Gans | 343/781 CA |
| 4,156,243 | 5/1979 | Yorinks et al. | 343/840 |
| 4,201,992 | 5/1980 | Welti | 343/840 |
| 4,236,161 | 11/1980 | Ohm | 343/781 |

OTHER PUBLICATIONS

Edward A. Ohm, "Multifixed-Beam Satellite Antenna with Full Area Coverage and a Rain-Tolerant Polarization Distribution", IEEE Transactions on Antennas and Propagation, vol. AP-29, No. 6, Nov. 1981.

*Primary Examiner*—Rolf Hille
*Assistant Examiner*—Doris J. Johnson
*Attorney, Agent, or Firm*—Noel F. Heal; Ronald L. Taylor

[57] ABSTRACT

A multibeam antenna system in which an antenna aperture element is deliberately selected to produce a divergent beam at a desired angular beamwidth. The antenna aperture may, for example, take the form of a hyperboloid reflector, a diverging lens, or a defocused paraboloid reflector. For the divergent secondary beams produced in these configurations, the angular beamwidth may be conveniently controlled by varying the mangification of the aperture or the degree of defocusing, without significantly affecting the gain or efficiency of the system. The degree of beam overlap may be independently controlled by scaling the size of the aperture, without significantly affecting the beamwidth, the gain or the efficiency.

10 Claims, 4 Drawing Sheets

HIGH-EFFICIENCY MULTIBEAM ANTENNA

The government has rights in this invention pursuant to contract No. N00039-81-C-0106 awarded by the Department of the Navy.

This application is a continuation of application Ser. No. 47,568, filed Apr. 22, 1987, which is a continuation of application Ser. No. 491,004, filed May 3, 1983.

BACKGROUND OF THE INVENTION

This invention relates generally to antenna systems, and more particularly, to antenna systems used for communication to and from satellites. In many satellite communication systems, there is a need to provide high-gain independent beams covering an angular region of space. In such cases it is usually highly desirable to provide the multiple beams from a single antenna aperture, to minimize the size and complexity of the antenna system. It is also usually desirable in such multiple beam systems to provide low sidelobe radiation patterns, to minimize out-of-beam interference.

A fundamental problem arises when any attempt is made to provide multiple high-gain beams from a single antenna aperture, whether it be in the form of a lens or a reflector. The peak gains that one can achieve in the multiple beams are typically much lower that one can achieve using a single optimum antenna feed horn at the focal region of the lens or reflector. In terms of decibels (dB), the peak gain of each of the multiple beams may be 3 dB or more lower than that of an optimum single-feed antenna beam. The principal object of the present invention is to overcome this problem.

An important application of multibeam antenna systems is in communication to or from a synchronous earth satellite, i.e., one whose position is fixed relative to the rotation of the earth. A multibeam antenna system on such a satellite has to provide contiguous coverage of practically one hemisphere of the earth. The half-angle subtended by the earth at the position of a synchronous satellite is approximately 8.68 degrees. In configuring an array of beams to cover this angular area, there is a tradeoff between maintaining sufficient isolation between adjacent beams, and providing contiguous coverage at a sufficient gain over the entire angular area of the earth. It has been recognized that a desirable compromise is to provide contiguous coverage at a power of at least half the peak power of each beam. For this reason the half-power beamwidth (HPBW) of each beam is an important factor. The HPBW is the angular width of the beam measured at a point where the gain is one-half of the peak gain at the center of the beam. If adjacent beams, as defined by their half-power beamwidths, overlap sufficiently to leave no gaps, the array of beams is said to provide contiguous coverage at the −3 dB level, or half-power level, or better.

A conventional high-frequency antenna system includes an antenna feed horn through which transmitted signals are directed, and a focusing element, such as a reflector or lens, to focus the energy radiated from the feed horn into a beam. If some of the energy from the feed horn does not impinge on the focusing element, the system is clearly not operating at maximum efficiency. The gain of the antenna system is maximized when the primary radiation from the feed horn is practically all incident on the focusing element, and none "spills over" the edges of the element.

Unfortunately, there is a fundamental disparity between the feed horn aperture size required to maximize gain and the feed horn size necessary to permit packing the beams at half-power beam width spacing. Specifically, it can be shown that the feed horn diameter to maximize gain is substantially larger than the feed horn diameter that will permit close packing, i.e. with coverage to the −3 dB level, in a single conventional focusing reflector or lens. Accordingly, horn aperture sizes that yield maximum gain lead to beam separations much larger than one half-power beamwidth.

For a single feed horn of given diameter, maximum gain is yielded by an optimum value of the reflector or lens included angle, i.e. the angle subtended by the reflector or lens at its focal region. However, if multiple feed horns of the same given diameter are placed side by side and used with the same reflector or lens arrangement, the resulting beams will be spaced from each other by much more than the desired 3 dB crossover. If one then makes either the horn feed diameters smaller or the included angle smaller, until the desired 3 dB crossover is obtained, some of the energy from the feed horns does not impinge on the reflector or lens. This "spillover" loss substantially reduces the overall efficiency of the antenna system. Furthermore, this limitation of conventional reflector and lens systems is independent of the focal length to aperture diameter ratio (F/D) of the reflector or lens.

In summary, for a given feed horn aperture in a focused antenna system of the prior art the only way to achieve a desired beam overlap for a given beamwidth is to vary the included angle of the lens or reflector of the system. For a desirable beam spacing at the −3 dB level, the lens or reflector included angle has to be reduced below its optimum value, and then there is "spillover" loss and lowered efficiency.

A possible solution to this problem is to provide multiple lenses or reflectors. Then each lens or reflector does not have to accommodate multiple beams in such a closely spaced relationship. However, the multiple lenses or reflectors introduce additional complexity, and must be maintained is very precise alignment for good results. It will be appreciated from the foregoing that there is a need for a single-reflector or singlelens multibeam antenna system capable of providing closely packed, secondary beams, but without degradation of the efficiency of the system. The present invention fulfills this need.

SUMMARY OF THE INVENTION

The present invention resides in a multibeam antenna system in which a desired beamwidth and beam spacing can be obtained without any sacrifice in antenna gain or efficiency. In addition, the invention includes a related method for adapting an antenna system to provide a desired angular beamwidth and a desired beam pattern overlap. The angular beamwidth may be varied independently of the diameter of the antenna aperture.

In terms of structure, the antenna system of the invention comprises an array of antenna feed horns and a single antenna aperture element, which may be a reflector or lens, configured in a non-focused manner. More specifically, there are two basic configurations that fall into the "non-focused" category. It is convenient to define these in terms of reflector structures, although it will be appreciated that there are equivalent lens structures that perform in an analogous manner. Existing antenna reflectors are of a parabolic or paraboloid shape and produce a nearly parallel beam from a diverging beam placed at the focus of the parabola. One embodiment of the invention uses instead a hyperbolic or hyperboloid reflector, which produces a diverging beam instead of a parallel beam. For a given feed horn aperture, the angular beamwidth of the secondary beam from the hyperboloid reflector is a function of the magnification factor of the reflector, and is essentially independent of the reflector diameter. Independent control of the degree of beam pattern overlap is obtained by varying the diameter of lens or reflector while maintaining the same proportions, and hence the same magnification factor and beamwidth.

A close approximation to the hyperbolic reflector is obtained by instead using an axially defocused parabolic reflector to obtain the necessary divergent secondary beams from the reflector. As in the hyperbolic reflector case, the beamwidth is controllable, in this case by varying the degree of defocusing, and the degree of beam pattern overlap can be varied by changing the reflector diameter without changing its proportions It will be appreciated from the foregoing that the present invention represents a significant advance in the field of multibeam antennas. In particular, the invention provides a multibeam antenna system with a single antenna aperture, which may be a reflector or a lens, having the desirable characteristics of high gain and efficiency over a wide range of feed horn sizes and feed-to-feed separations. Importantly, the antenna system of the invention can be easily designed to provide any of a wide range of beam-to-beam separations or crossover levels, and to provide a beamwidth that is selectable independently of the antenna aperture. In addition, the system allows for efficient and simple sidelobe control, to provide for minimal out-of-beam interference. These and other aspects of the invention will become apparent from the following more detailed description, taken in conjunction with the accompanying drawings.

BRIEF DESCRIPTION OF THE DRAWINGS

.

DESCRIPTION OF THE PREFERRED EMBODIMENTS

Figure 1:
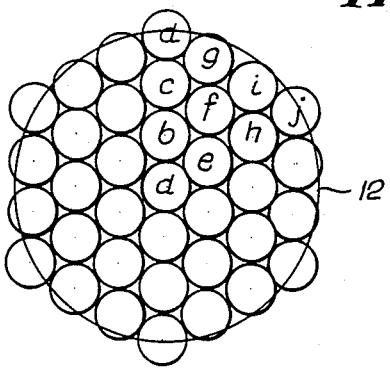
FIG. 1 is diagrammatic view showing the positions of multiple antenna beams in relation to the earth as viewed from a synchronous satellite.

As shown in the drawings for purposes of illustration, the present invention is concerned with multibeam antennas,. Such antennas are useful in a variety of applications, including some satellite and ground-based communications systems, and monopulse tracking systems. For purposes of this detailed description, the antenna of the invention is disclosed in relation to a satellite communication system requiring a closely packed array of multiple beams of high gain and high efficiency.

From time to time in this description, the antenna of the invention will be discussed in terms of its function as a transmitter, merely because the concepts involved can usually be more easily understood by consideration of the transmitter action. It will be appreciated, however, that similar but reciprocal considerations apply to the antenna system in its role as a receiver.

FIG. 1 shows the positions of thirty-seven antenna beams, shown as small circles, in relation to the earth, indicated by reference numeral 12, as viewed from the position of a synchronously orbiting satellite. The earth as viewed from such a satellite subtends a half-angle of approximately 8.68 degrees. The geometrical relationships are such that, to provide contiguous coverage of the visible earth surface at a gain of at least half the peak beam gain, the multiple beams must have a half-power beamwidth of approximately 3.3 degrees and an angular center-to-center separation of approximately 2.9 degrees. The half-power beamwidth (HPBW) is the angular width of a beam taken at a circular line defining a constant gain of one-half the peak gain of the beam.

Figure 2:
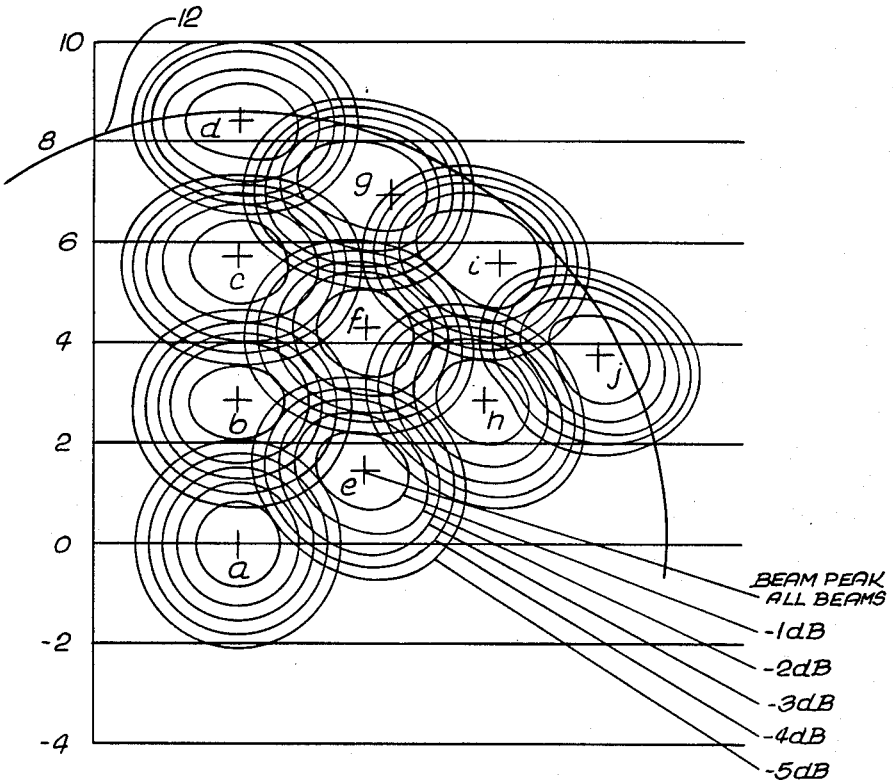
FIG. 2 is a diagrammatic view of a portion of FIG. 1, drawn to an enlarged scale and showing how the gain for each of ten beams varies from its peak to −5 dB.

FIG. 2 shows the gain patterns for ten of the beams, indicated by letters a–j in both FIGS. 1 and 2. It will be observed that, in the regions where the beam patterns overlap, the curves defining a −3 dB gain always overlap to such a degree that no region between beam patterns is exposed to a gain that is more than 3 dB below the peak. This diagram represents the desired coverage to be provided by an illustrative antenna system. However, before the invention can be described in detail there should be an understanding of the limitations of focused antenna systems of the prior art.

Figure 6A:
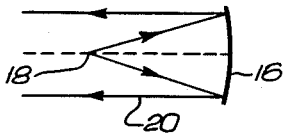
Fig. 6a PRIOR ART
FIGS. 6*a*–6*c* are diagrammatic views of three types of focusing antennas, including a paraboloid, an offset paraboloid, and a focusing lens, respectively.
Figure 6B:
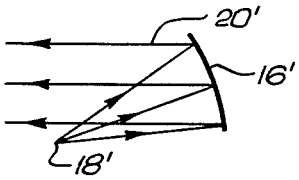
Figure 6C:
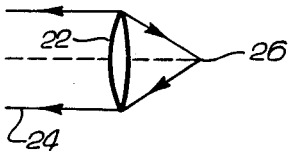

The usual approach to the design of a directional antenna system involves the use of a focused antenna aperture, which is usually a reflector or a lens. FIG. 6*a* shows a paraboloid reflector 16, receiving radiation from a focal point 18. As is well known, a parabola has associated with it a focal point at which parallel beams impinging on its surface will converge. Conversely, radiation from the focal point will produce a theoretically parallel secondary beam of radiation 20. FIG. 6*b* shows an offset paraboloid reflector 16' on which primary radiation impinges from a focal point 18', resulting in a parallel beam 20'. Finally, as shown in FIG. 6*c*, a lens 22 may be used to produce a parallel beam 24 from a source of radiation located at a focal point 26.

It will be recognized that these antenna elements have closely similar counterparts in the field of optics, but there are some important differences that render the optical analogy inaccurate in some respects. Because the wavelengths of radio communication signals are very much higher than the wavelengths of visible light, the size of the reflector and lens elements can have a significant influence on the behavior of the antenna system. For example, although a nearly parallel beam of light may be obtained from a parabolic mirror, generation of a parallel beam at radio frequencies is a practical impossibility. Because the diameter of the reflector is not infinitely larger than the wavelength of the radiation, diffraction effects result in a slightly diverging beam. Moreover, the angular beamwidth of the reflected beam is highly dependent on the diameter of the reflector.

If a single antenna feed horn is used in conjunction with a reflector, such as the one in FIG. 6*b*, there is an optimum combination of reflector included angle and feed horn size needed to produce maximum gain. As the diameter of an antenna feed horn is decreased, a wider primary angular beamwidth results. As the feed horn size is increased, the resulting primary beam has a correspondingly smaller angle. It will be apparent, then, that for a given size of reflector, the feed horn should be sized to produce a primary beam that practically fills the reflector aperture. Any larger primary angle will result in "spillover" loss of the energy not incident on the reflector. Any smaller angle also results in losses.

Figure 3:
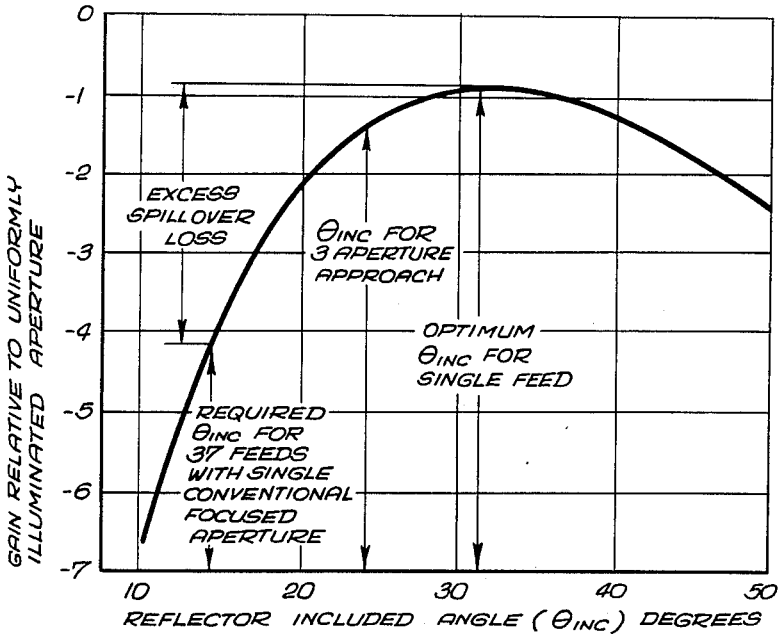
FIG. 3 is a graph showing the relationship between reflector gain and reflector included angle, for a single antenna feed horn of fixed diameter, and a beam of fixed half-power beamwidth.

An alternative way to optimize a single beam is to keep the feed horn size constant and vary the reflector included angle, i.e. the angle subtended at the focus of the reflector by the reflector diameter. This is shown graphically in FIG. 3, which plots the variation of gain as a function of reflector included angle. To obtain the data on which FIG. 3 is based, the feed horn diameter was fixed at one inch, corresponding to approximately four wavelengths at a frequency of 44.5 gigahertz (GHz), and the half-power beamwidth was kept nearly constant at 3.3 degrees. Beamwidth control for a parabolic reflector is obtained by varying the diameter. Because of the diffraction effects mentioned earlier, the angular beamwidth varies inversely with the diameter of the reflector. With the diameter essentially fixed by the beamwidth requirement, the included angle of the reflector can be varied by changing the focal length of the reflector. As the focal length is increased, the included angle is decreased. As FIG. 3 shows, the gain peaks at an included angle of approximately 32 degrees. At smaller included angles, some of the primary radiation spills over the edge of the reflector and the gain and efficiency are diminished.

It can b shown that, if multiple antenna feed horns of the same size as used to obtain the FIG. 3 curve are placed side by side, and if the included angle of the reflector is maintained at 32 degrees, the resulting multiple beam images do not overlap at the required −3 dB level, as required in the earth satellite application described above. Rather, the crossover point of the adjacent beams is at a gain much more than 3 dB below the beam peak gain. To bring the beams into a greater degree of overlap, a longer focal length can be used. With a longer focal length, a fixed feed-to-feed transverse spacing will have a smaller equivalent angular separation in the secondary radiation from the reflector. However, increasing the focal length decreases the included angle of the reflector, and the gain of the antenna is then reduced by "spillover" loss, as shown in FIG. 3. To reduce the angular separation sufficiently to produce a −3 dB or better overlap of the beam patterns requires a reduction in included angle to about 15 degrees, and results in a loss in gain of between 3 and 4 dB as compared with the optimum gain of a single beam.

Figure 4:
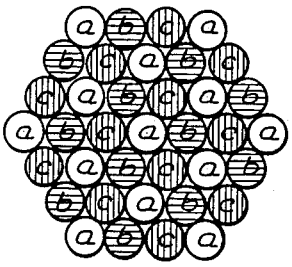
FIG. 4 is a diagrammatic view showing how the beam positions of FIG. 1 can be divided into three groups for transmission from three separate antenna apertures.
Figure 5A:
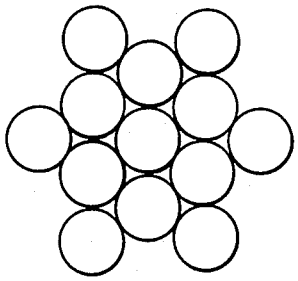
FIGS. 5*a*–5*b* are three diagrammatic views showing three antenna feed arrays for use with separate antenna apertures to produce the beam positions of FIG. 4.
Figure 5B:
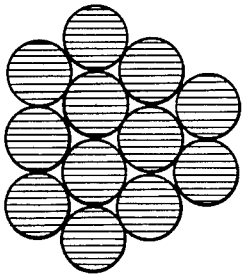
Figure 5C:
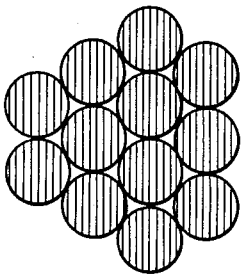

One possible solution to this problem is to increase the number of beams needed to provide coverage. However, the accompanying increase in complexity is sufficient to rule out this approach. A related solution is to provide multiple reflector apertures, each with a subset of the required total beam pattern. For example, FIG. 4 shows the same thirty-seven beam positions divided into three groups, so that in no group are there any two beams that were in adjacent positions in the original array. The feed horn arrangements for the groups labelled a, b and c are shown in FIGS. 5*a*–5*c*, respectively. Since any two adjacent feeds in one of the groups now produce two more widely spaced beams in the composite array, the included angle for each reflector can be much greater than the 15-degree value needed to produce a −3 dB crossover for adjacent beams. The closest spacing that occurs between beams produced by adjacent feed horns in the same group is about 1.73 times the half-power beam width. This larger separation allows the included angle to be about 24 degrees, and results in a spillover loss of less than 1 dB. The reflector diameter for each of the three reflectors is about five inches, or close to twenty wavelengths. However, the cost and alignment problems associated with multiple reflector apertures are substantial. Also, the edge illumination in the system is relatively high and there is no simple way to control the beam sidelobe levels. Finally, there is no convenient way to control the beamwidth and beam spacing independently in the multiple aperture system, or any system using focused antenna apertures.

Figure 7A:
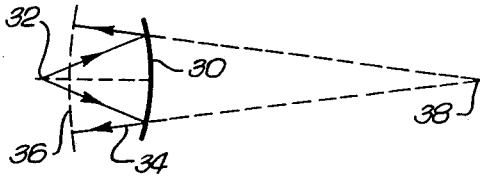
FIGS. 7*a* and 7*b* are diagrammatic views of two types of non-focusing antennas used in the present invention.
Figure 7B:
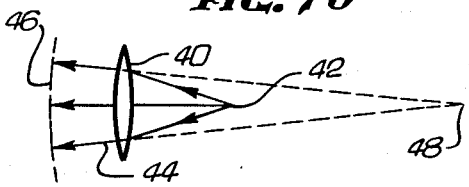

In accordance with the present invention, a non-focused antenna aperture is employed instead of a focused one, to allow the angular beamwidth and the beam gain crossover level to be independently selected and controlled without loss in gain or antenna efficiency. FIGS. 7*a* and 7*b* show two non-focused antenna apertures that can be used in practicing the invention. FIG. 7*a* shows a hyperboloid reflector 30 receiving a primary beam from a point 32 and reflecting a diverging secondary beam 34, which has a spherical wavefront 36 centered at a focal point 38 located behind the reflector 30. FIG. 7*b* shows an equivalent lens structure, including a diverging lens 40 receiving primary radiation from a point 42, resulting in a diverging beam 44. The diverging beam has a spherical wavefront 46 centered at a virtual source point 48 located on the same side of the lens as the primary source 42.

For the hyperbolic reflector, the magnification is defined as the ratio of the primary beam angle at point 32 (FIG. 7*a*) to the resulting secondary beam angle measured at point 38. For example, if the magnification is 10 the primary beam angle would have to be 33 degrees to produce a desired half-power beamwidth of 3.3 degrees. The relationship between secondary half-power beamwidth and feed horn size is plotted in FIG. 11 for various magnifications. For relatively low magnifications, up to 10 or so, the secondary HPBW first decreases as the feed horn size is increased. It will be recalled that increasing the feed horn size provides a smaller primary beamwidth. This results in a correspondingly smaller secondary HPBW. However, as the feed horn size approaches 7–10 wavelengths, the primary beam becomes limited to a region quite close to the center of the reflector. Although the resulting secondary beam is still divergent, the magnification of the reflector has less effect and the curves for the different magnifications tend to merge into one.

For a hyperbola of large magnification, such as 25 or more, the behavior is practically that of a parabolic reflector. The secondary beam is practically parallel for low feed horn sizes. Then, as the feed horn size is increased the diameter of the beam is reduced and diffraction effects reduce the degree of parallelism of the beam. In other words, the secondary HPBW increases as the horn size is increased. This curve also merges with the others in the region of a 7–10 wavelength horn size.

Figure 11:
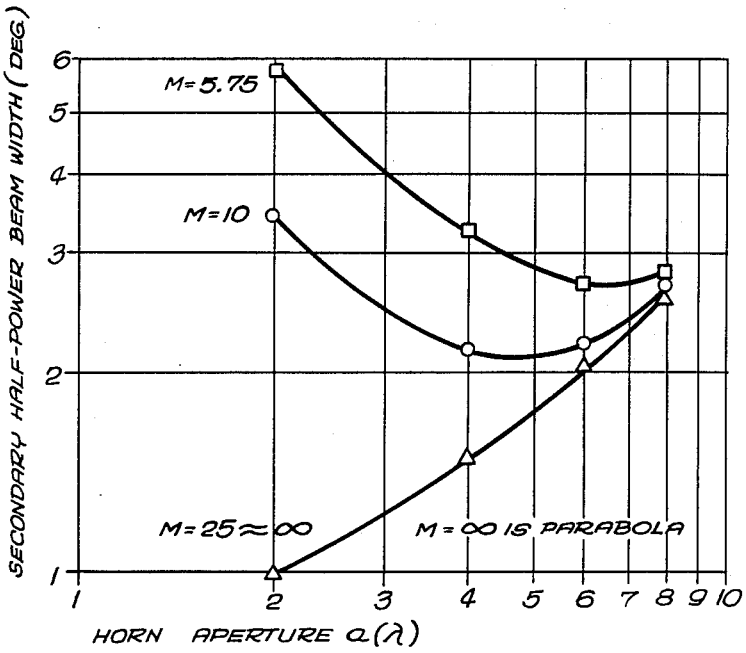
FIG. 11 is a graph showing the how the half-power beamwidth of a hyperbolic antenna system varies as a function of feed horn aperture and reflector magnification.

The most important aspect of FIG. 11 is that there is a range of feed horn sizes, up to about 5 wavelengths in diameter, over which the secondary HPBW is solely a function of magnification. For example, one can obtain a secondary HPBW of 3.3 degrees by selecting a horn size of four wavelengths and a reflector with a magnification of 5.75. A desired sidelobe performance can be first optimized, to provide a suitable degree of isolation between adjacent beams. Then, assuming that the magnification and feed horn design have been fixed to provide a desired secondary HPBW, the desired crossover level can be selected by adjusting the physical size of the reflector. For example, if closer beam spacing is required, with crossover to be changed from a −6 dB level to a −3 dB level, the reflector can be scaled up in size. Its focal distances are also scaled up, but their ratio, and so also the magnification, remain unchanged. However, the increase in focal length results in a crossover at the desired gain level.

It is important to note that, when the reflector is scaled up in this manner, the focal length, which determines the spacing between the reflector and the feed horns, is also scaled up. If the reflector is initially optimized for maximum gain, i.e. if the primary beam energy is almost totally incident on the reflector, this optimization will still hold good after scaling of the reflector. Thus, the high gain and efficiency of the system will be maintained even if the degree of beam overlap is adjusted. Similarly, the optimization is not affected when the magnification of the reflector is changed to select a desired angular beamwidth.

Figure 8:
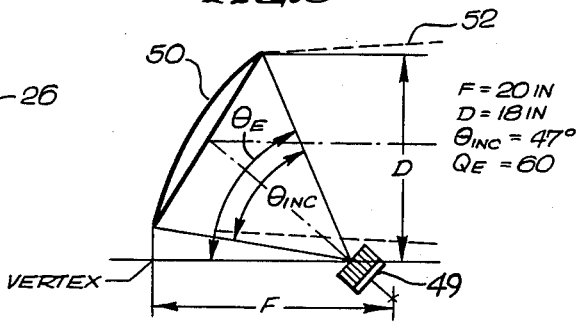
FIG. 8 is a diagrammatic view showing an axially defocused parabolic antenna system in accordance with one embodiment of the invention.
Figure 9:
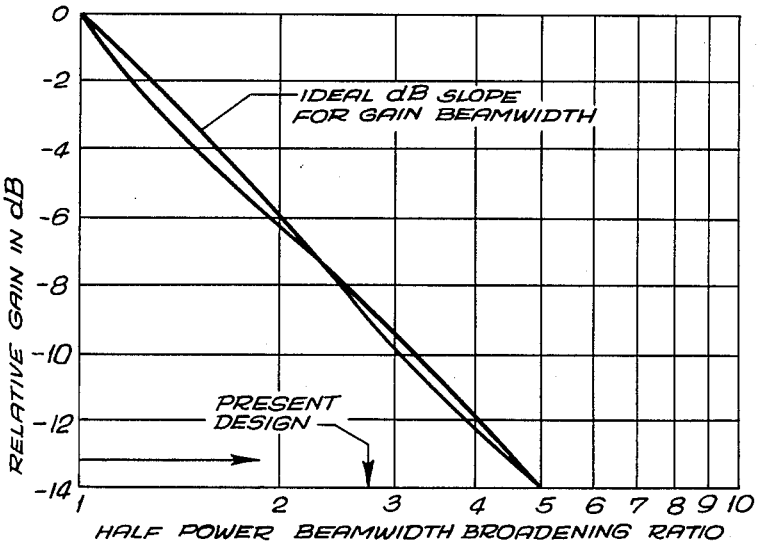
FIG. 9 is a graph showing the relationship between loss of gain due to defocusing, and the half-power beamwidth broadening ratio due to defocussing of a parabolic antenna system.
Figure 10:
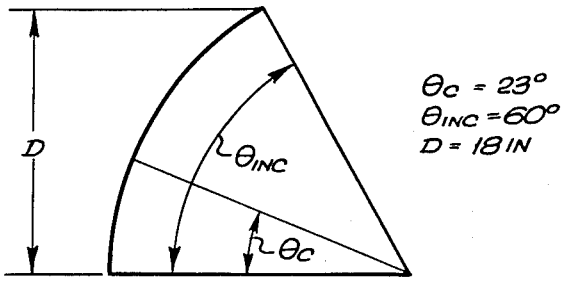
FIG. 10 is a diagrammatic view showing the angular relationships in a hyperbolic antenna system in accordance with another preferred embodiment of the invention.

The results obtained using the hyperbolic reflector characteristics shown in FIG. 11 can be closely approximated by defocusing a parabolic reflector. As shown in FIG. 8, defocusing may be effected by axial displacement of the feed horns 49 supplying the primary beam to the reflector 50. The effect is to produce a divergent beam 52, which is broadened in accordance with the relationship plotted in FIG. 9. Ideally, there is a straight-line relationship between the defocused gain loss and the HPBW broadening ratio. What FIG. 9 shows is that, at the expense of a loss in gain, which is inherent in any divergent beam, the HPBW can be broadened substantially. This is equivalent to raising the lower curve in FIG. 11 by the HPBW broadening factor. By this means one can obtain the desired 3.3 degree HPBW from a defocused parabolic reflector.

It will be appreciated from the foregoing that the present invention represents a significant advance in the field of multibeam antennas. In particular, by using a defocused or nonfocused antenna aperture, the invention provides a novel technique for independently obtaining a desired angular beamwidth and beam spacing without loss of gain or antenna efficiency. It will also be appreciated that, although specific embodiments of the invention have been described in detail for purposes of illustration, various modifications may be made without departing from the spirit and scope of the invention. Accordingly, the invention is not to be limited except as by the appended claims.

I claim:

1. A multibeam antenna system, comprising:

a single antenna aperture element for producing a plurality of secondary beams of radiation from an equal plurality of primary beams of radiation impinging on said aperture element; and a plurality of antenna feed horns positioned in an array to produce the plurality of primary radiation beams;

wherein said aperture element and said antenna feed horns are configured to be non-focused, the degree of non-focusing and the aperture size of said feed horns being selected to maximize the gain of the antenna system and to produce the secondary radiation beams as diverging beams with a desired beamwidth at a specified power level;

and wherein the diameter of said antenna aperture element is adjusted to provide an overlap of the secondary radiation beams that produces contiguous coverage of an area by the secondary radiation beams at the specified power level, while maintaining the degree of non-focusing and the aperture size of said feed horns to preserve the maximized gain of the antenna system and the beamwidth of the secondary radiation beams.

2. An antenna system as set forth in claim 1, wherein:

said aperture element is a paraboloid reflector;

the degree of non-focusing is selected by axially displacing said antenna feed horns with respect to the focal point of said paraboloid reflector; and the degree of the non-focusing is maintained while adjusting the diameter of said aperture element by adjusting proportionately the focal length of said paraboloid reflector as the diameter of said paraboloid reflector is adjusted.

3. An antenna system as set forth in claim 1, wherein:

said aperture is a hyperboloid reflector;

the degree of non-focusing is selected by adjusting the magnification factor of said hyperboloid reflector; and the degree of non-focusing is maintained while adjusting the diameter of said aperture element by adjusting proportionately the focal length of said hyperboloid reflector as the diameter of said hyperboloid reflector is adjusted.

4. An antenna system as set forth in claim 1, wherein:

said aperture element is a diverging lens.

5. A multibeam antenna system comprising:

a single antenna reflector for producing a plurality of secondary beams of radiation from an equal plurality of primary beams of radiation impinging on said reflector; and a plurality of antenna feed horns positioned in an array to produce the plurality of primary radiation beams;

wherein said reflector and said antenna feed horns are configured to be non-focused, the degree of non-focusing and the aperture size of said feed horns being selected to maximize the gain of the antenna system and to produce the secondary radiation beams as diverging beams with a desired half-power beamwidth;

and wherein the diameter of said reflector is adjusted to provide an overlap of the secondary radiation beams that produces contiguous coverage of an area by the secondary radiation beams at the half-power level, while maintaining the degree of non-focusing and the aperture size of said feed horns to preserve the maximized gain of the antenna system and the beamwidth of the secondary radiation beams.

6. A multibeam antenna system as set forth in claim 5, wherein:

said reflector is a paraboloid reflector;

the degree of non-focusing is selected by axially displacing said antenna feed horns with respect to the focal point of said paraboloid reflector; and the degree of non-focusing is maintained while adjusting the diameter of said antenna reflector by adjusting proportionately the focal length of said paraboloid reflector as the diameter of said paraboloid reflector is adjusted.

7. A multibeam antenna system as set forth in claim 5, wherein:

said reflector is a hyperboloid reflector;

the degree of non-focusing is selected by adjusting the magnification factor of said hyperboloid reflector; and the degree of non-focusing is maintained while adjusting the diameter of said antenna reflector by adjusting proportionately the focal length of said hyperboloid reflector as the diameter of said hyperboloid reflector is adjusted.

8. A method of adapting a multibeam antenna system to provide desired beam characteristics without significant loss of gain or efficiency, said method comprising the steps of:

selecting a plurality of antenna feed horns positioned in an array and a single antenna reflector, the antenna reflector and the antenna feed horns being configured to be non-focused;

selecting the degree of non-focusing and the aperture size of the feed horns to maximize the gain of the antenna system and to produce secondary radiation beams that diverge from the reflector with a desired angular beamwidth at a specified power level; and scaling the reflector in size to adjust the secondary beam overlap to produce contiguous coverage of an area by the secondary radiation beams at the specified power level, while maintaining the degree of non-focusing and the aperture size of the feed horns to preserve the maximized gain of the antenna system and the beamwidth of the secondary radiation beams.

9. A method as set forth in claim 8, wherein:

the antenna reflector is a hyperboloid reflector;

the degree of non-focusing is selected by adjusting the magnification factor of the hyperboloid reflector; and the degree of non-focusing is maintained while adjusting the diameter of the antenna reflector by adjusting proportionately the focal length of the hyperboloid reflector as the diameter of the hyperboloid reflector is adjusted.

10. A method as set forth in claim 8, wherein:

the antenna reflector is a paraboloid reflector;

the degree of non-focusing is selected by axially displacing the antenna feed horns with respect to the focal point of the paraboloid reflector; and the degree of non-focusing is maintained while adjusting the diameter of the antenna reflector by adjusting proportionately the focal length of the paraboloid reflector as the diameter of the paraboloid reflector is adjusted.

* * * * *